US006120039A

United States Patent [19]

Clementi

[11] Patent Number: 6,120,039

[45] Date of Patent: Sep. 19, 2000

[54] WALKING AND IN-LINE SKATE SHOE

[76] Inventor: Fred Clementi, P.O. Box 1285, Warrenton, Va. 20188

[21] Appl. No.: 09/374,848

[22] Filed: Aug. 16, 1999

[51] Int. Cl.[7] ..... A63C 17/00; A63C 17/04; A43B 5/04

[52] U.S. Cl. ..... 280/11.19; 280/11.23; 280/11.27; 36/115

[58] Field of Search ..... 280/11.19, 11.2, 280/11.22, 11.26, 11.25, 11.27, 11.3, 11.31, 11.32, 11.33, 841; 36/115, 15

[56] References Cited

U.S. PATENT DOCUMENTS

| | | | |
|---|---|---|---|
| 3,884,485 | 5/1975 | Walle | 36/115 |
| 3,979,842 | 9/1976 | Texidor . | |
| 3,983,643 | 10/1976 | Schreyer et al. . | |
| 4,333,249 | 6/1982 | Schafer . | |
| 4,928,982 | 5/1990 | Logan . | |
| 5,398,970 | 3/1995 | Tucky . | |
| 5,511,824 | 4/1996 | Kim . | |
| 5,785,327 | 7/1998 | Gallant . | |
| 5,797,609 | 8/1998 | Fichepain . | |
| 5,803,469 | 9/1998 | Yoham | 280/11.27 |
| 5,882,018 | 5/1999 | Petrosino | 36/115 |
| 6,042,125 | 3/2000 | Wu | 280/11.27 |

*Primary Examiner*—Lanna Mai
*Assistant Examiner*—Jeff Restifo
*Attorney, Agent, or Firm*—Swidler Berlin Shereff Friedman, LLP

[57] ABSTRACT

A convertible shoe that can be used for walking or for in-line skating having an extendable and retractable wheel mechanism. The convertible shoe includes cavities in the sole of the shoe capable of storing and enclosing the retracted wheel mechanism. The wheel mechanism allows the wheels to be held perpendicular to the walking surface of the sole when the wheel mechanism is extended, and parallel to the walking surface of the sole when the wheel mechanism is retracted. With the wheel mechanism extended, the convertible shoe can be used for in-line skating. With the wheel mechanism retracted and stored in the sole, the convertible shoe can be used for walking.

3 Claims, 10 Drawing Sheets

WALKING AND IN-LINE SKATE SHOE

BACKGROUND OF THE INVENTION

1. Field of the Invention

The present invention relates to a convertible shoe that can be converted from a walking shoe into an in-line skate by extending a swivel hinge wheel mechanism concealed in the sole of the shoe.

2. Description of the Related Art

Convertible shoes capable of converting from walking shoes into in-line skates are known in the art. One type of known convertible shoe comprises a shoe component, or upper, attached at its underside to a wheel mechanism, and to a sole. The wheel mechanism comprises wheels rotatably connected to an undercarriage, the undercarriage being connected to the underside of the upper. The wheel mechanism can be extended to allow a wearer to skate on a skating surface, or retracted to allow a wearer to walk. When extended, the wheel mechanism can provide clearance between the sole and the skating surface, and can support the upper some distance above the skating surface allowing the upper and sole to ride on the wheels or rollers. When retracted, the wheel mechanism provides no clearance between the upper and sole and the ground or skating surface and can be enclosed by the sole. The sole contains cavities that provide a storage enclosure for the retracted wheel mechanism.

There are inconveniences and problems associated with this type of known convertible shoe. Wheel diameter is limited to about 1 inch or less because the wheels must fit in the enclosing space provided by the sole. When the wheel mechanism is retracted, the wheels remain roughly perpendicular to the underside of the upper, so that their rolling axes are parallel to the upper's underside. Therefore, wheel diameter can generally be no greater than the thickness of the enclosing sole. The smaller the wheels' diameter, the greater the number of revolutions a wheel must make to travel a given distance, and the greater a wheel's wear. Small wheels are also generally less able to negotiate bumps and undulations in the skating surface. Further, small wheels can limit the clearance between the upper or sole and the skating surface, making skating more hazardous and preventing more aggressive skating. Examples of this type of convertible shoe are taught in U.S. Pat. No. 3,983,643 to Schreyer, U.S. Pat. No. 4,333,249 to Schaefer, U.S. Pat. No. 5,797,609 to Fichepain, and U.S. Pat. No. 5,785,327 to Gallant.

Another type of known convertible shoe is similar to the convertible shoe just described except that the sole is detachable. In this type of convertible shoe, the sole is generally attached to the upper when the wheel mechanism is retracted, thus covering and enclosing the retracted wheel mechanism, and allowing a wearer to walk in the convertible shoe. When the wheel mechanism is to be extended, the sole is removed and either must be set aside or carried separately by the wearer. In addition to the problems arising from small wheel diameters, having to remove and set aside, or carry, the sole is inconvenient for the wearer. An example of this type of convertible shoe is described in U.S. Pat. No. 3,979,842 to Texidor.

Still another type of known convertible shoe provides wheel mechanisms wherein the wheels are mounted at the sides of the sole and protrude therefrom. When used for skating, the wheels may be lowered, or extended downwards, to contact the skating surface and provide clearance between the sole of the shoe and the ground. When used for walking the wheels are raised by the sides of the shoe, allowing the sole to contact the ground. An example of this is described in U.S. Pat. No. 5,398,970 to Tucky. In an alternative design, the wheels are attachable to axles embedded in the sole. The wheels are attached to the axles when the shoe is to be used for skating and protrude from the sides of the sole. When used for walking, the wheels are removed. An example of this design is found in U.S. Pat. No. 5,511,824 to Kim. This type of convertible is not suitable for in-line skates because the wheels must be mounted on both sides of the sole. The Kim convertible shoe is also inconvenient because the wheels are not integral with the shoe, and they must be set aside or carried when the user is skating.

Known convertible shoe wheels that are integral with and fixed to the convertible shoe can be subject to uneven wheel wear. The wheels' orientation is generally fixed in a plane parallel to the direction of in-line skate travel, and the orientation cannot easily be reversed or rotated through 180 degrees. With prolonged skating, wheel wear can be uneven if, for example, the wearer's feet tilt inwards or outwards while skating. Unevenly worn wheels are undesirable because they are difficult to skate with.

Therefore, a need exists for improved integrated convertible shoes.

BRIEF SUMMARY OF THE INVENTION

The present invention relates to a convertible shoe capable of reversibly converting from a walking shoe to an in-line skate by extending a wheel mechanism located in the shoe's sole. The convertible shoe comprises an upper, a sole connected to the underside of the upper, and an extendable and retractable wheel mechanism connected to the underside of the upper. The sole has storage cavities capable of enclosing and storing the retracted wheel mechanism. In one embodiment the wheel mechanism comprises at least two wheels rotatably mounted on one or more undercarriages that permit wheels connected thereto to be extended by swiveling about an axis perpendicular to the wheels' rolling axis. Swiveling can be achieved by mounting each wheel on an undercarriage via, for example, a swivel-hinge mounting. There are several possible undercarriage configurations. For example, each wheel can be mounted on a separate undercarriage, with undercarriage extendibly connected to the underside of the upper. When the wheel mechanism is extended the swivel-hinge mounting can be locked in a position such that its wheel is held parallel to the direction of skating motion and about perpendicular to the sole. When the wheel mechanism is retracted, the swivel-hinge mounting permits the wheel to swivel through about 90 degrees and lie flat on the sole so that the wheel is roughly parallel to the sole. Thus retracted, the wheel can be enclosed by the sole even though the wheel's diameter is greater than the sole's thickness. The swivel-hinge mountings also permit the wheel orientation to be reversed, so that with the wheel mechanism extended, a wheel can be held in either of two positions 180 degrees apart, and parallel to the skating direction.

In another embodiment of the present invention, the wheel mechanism can comprise at least two removable undercarriages having rotatable wheels. Each undercarriage can be mounted onto the convertible shoe so that the undercarriage and the wheel connected thereto can be held in at least two different orientations. For example, the undercarriage can be mounted in an extended orientation with its wheel parallel to the skating direction and about perpendicular to the sole of the shoe, or the undercarriage can be mounted in a retracted orientation with its wheel about parallel to the sole of the convertible shoe. To change the wheel orientation the undercarriage can be dismounted from the bushing then remounted with wheels in a different orientation.

One advantage of the convertible shoe of the present invention is the shoe is integrally constructed so that no accessories need to be attached or removed from the convertible shoe in converting the shoe from a walking shoe to an in-line skate.

Another advantage of the integral convertible shoe of the present invention is the extendable and retractable wheel mechanism can have wheels with diameters greater than the thickness of the sole that can be enclosed and stored in the sole of the convertible shoe.

Another advantage of the integral convertible shoe of the present invention is the convertible shoe can have wheels with diameters greater than about 1 inch.

Another advantage of the integral convertible shoe of the present invention is the shoe useable as an in-line skate that permits safer yet more aggressive skating.

Another advantage of the integral convertible shoe of the present invention is the shoe is useable as an in-line skate, the shoe having wheels with orientations parallel to the skating direction, wherein the wheels can be swiveled through 180 degrees so that their orientation can be reversed.

Yet another advantage of the integral convertible shoe of the present invention is the shoe is useable as an in-line skate, wherein the wheels' orientation can be reversed to permit even wear of the wheels.

Still another advantage of the integral convertible shoe of the present invention is the shoe is useable as an in-line skate, wherein the wheels are stored about parallel to the sole of the shoe, with their rolling axes parallel to the sole.

These and other features and advantages of the invention will be apparent from the following description of embodiments thereof and from the claims.

DETAILED DESCRIPTION OF THE INVENTION

Figure 1:
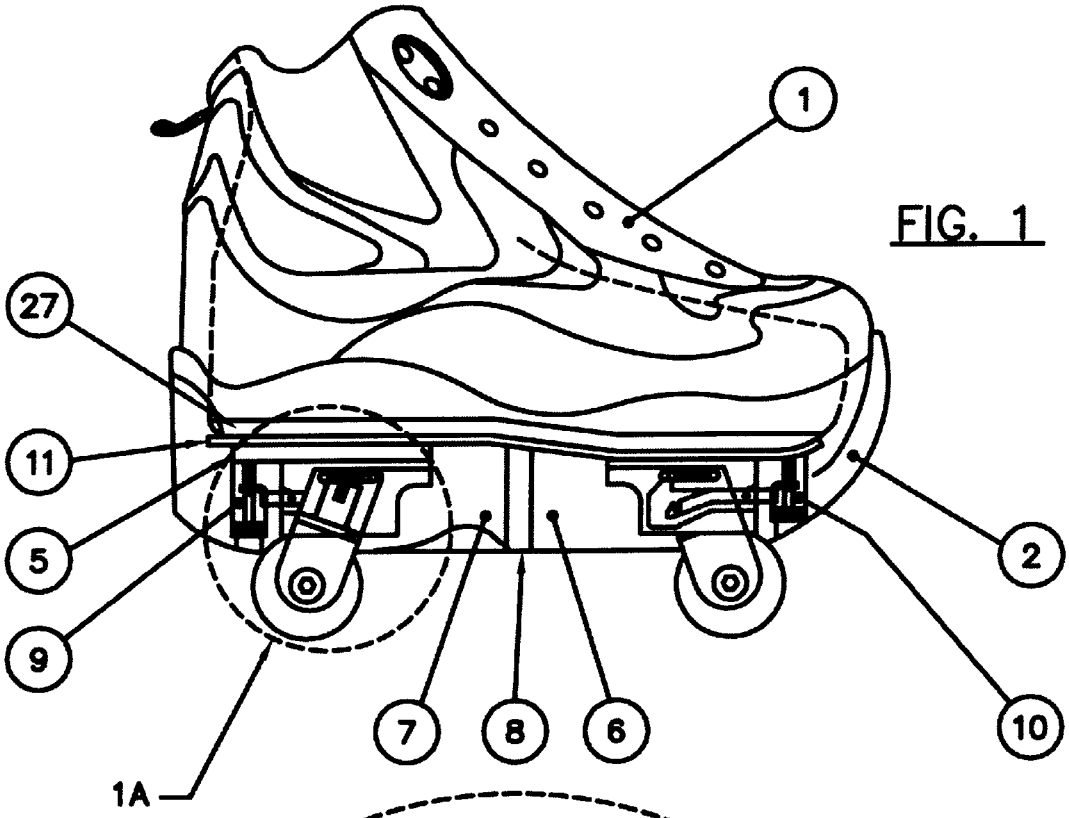
FIG. 1 is a side partial sectional view of an embodiment of the present invention with the wheel mechanism extended.
Figure 2:
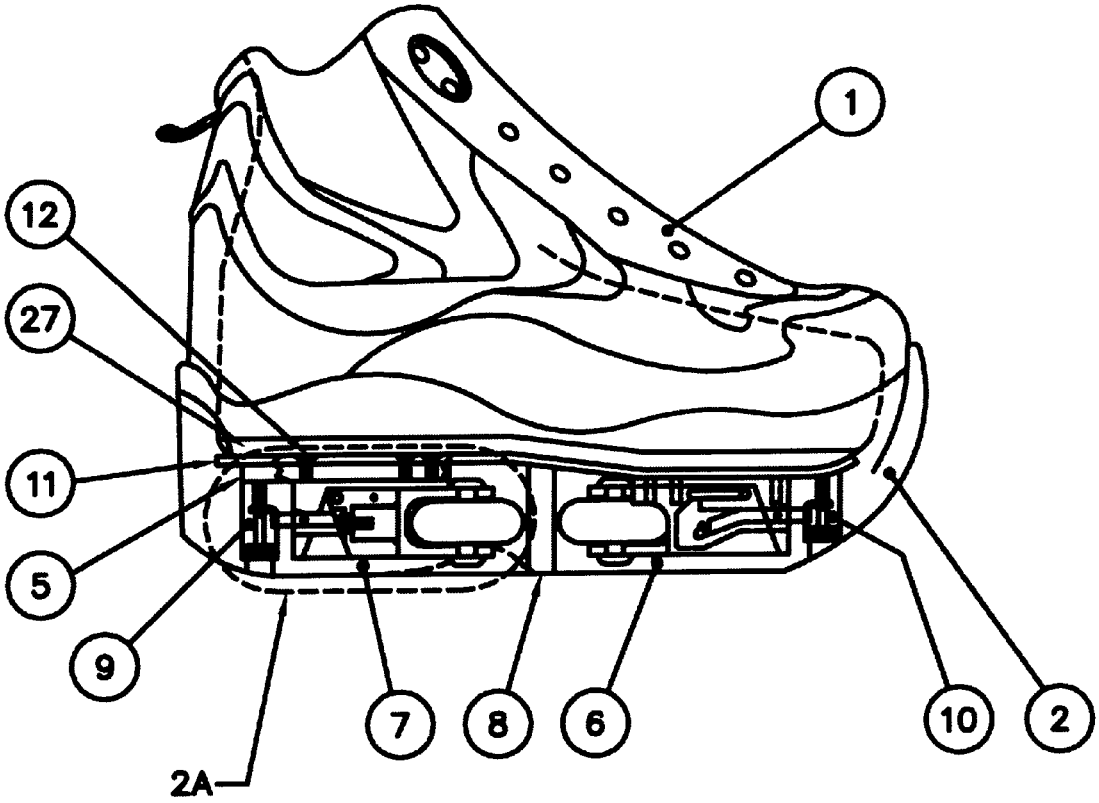
FIG. 2 is a side partial sectional view of an embodiment of the present invention with the wheel mechanism retracted.

One embodiment of the present invention is a convertible shoe having a retractable and extendable wheel mechanism, wherein the convertible shoe is useable as an in-line skate when the wheel mechanism is extended, as shown in FIG. 1, and is useable as a walking shoe when the wheel mechanism is retracted, as shown in FIG. 2. The convertible shoe comprises an upper 1 and a sole 2 attached to the underside of the upper 1 to form an upper/sole assembly shown in FIG. 3. The upper/sole assembly can further comprise an insole 27, a plate 11 located under the insole 27, and an heel pad 5 located under the posterior of the plate 11, attached to the underside of the upper 1 and above the sole 2.

The upper 1 is capable of receiving a user's or wearer's foot and can be made of materials including leather, fiber, or synthetic material. The insole 27 cushions a wearer's foot, and can be made of, for example, a resilient synthetic material. The plate 11, shown in a top side view in FIG. 3A, can be made of, for example, non-corrosive metal or rigid synthetic material capable of providing structural support for the wheel mechanism. The heel pad 5 acts as a spacer, and provides support for the wearer's heel at the posterior end of plate 11.

Figure 3:
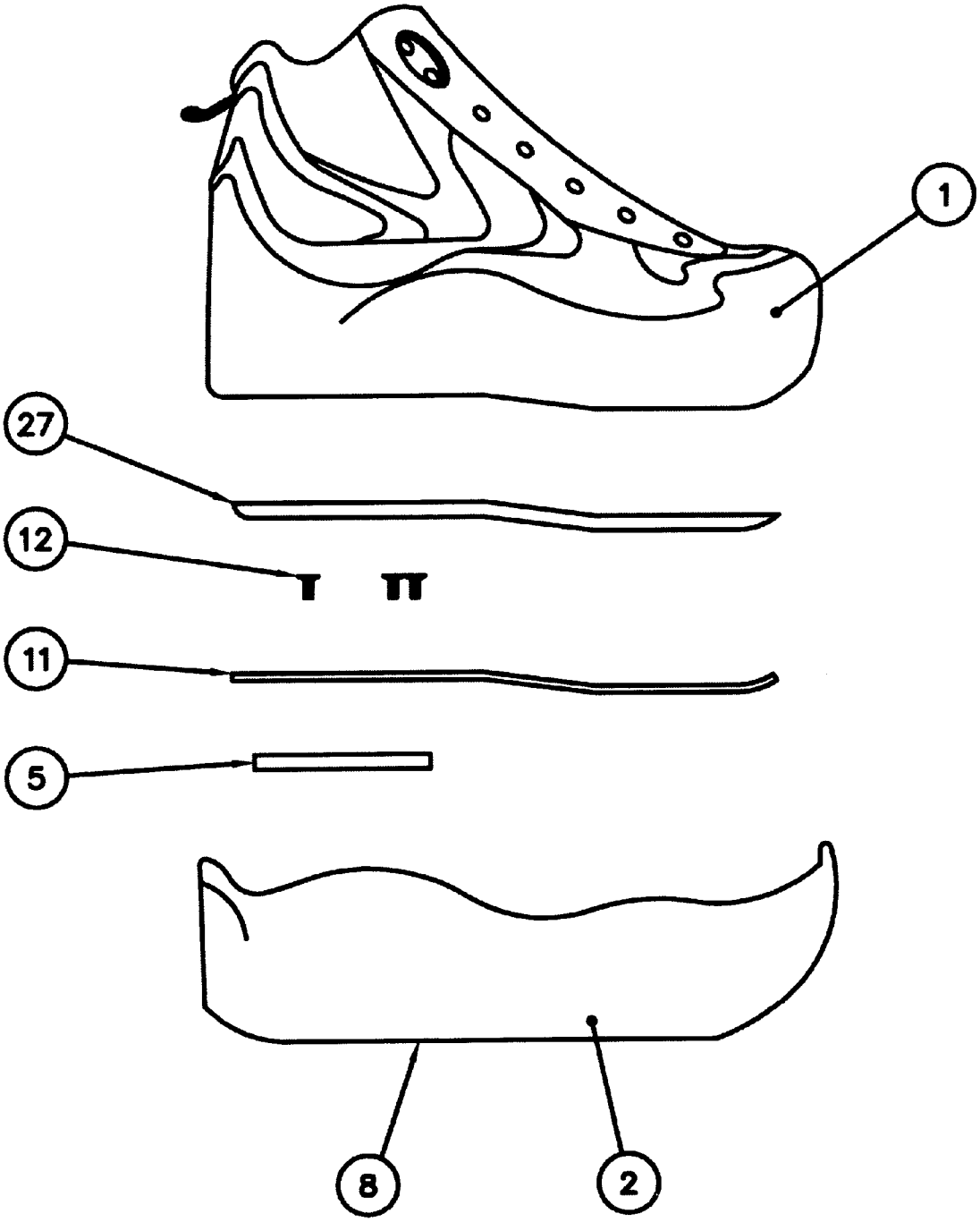
FIG. 3 is an exploded view of the upper/sole assembly of an embodiment of the present invention.
Figure 3A:
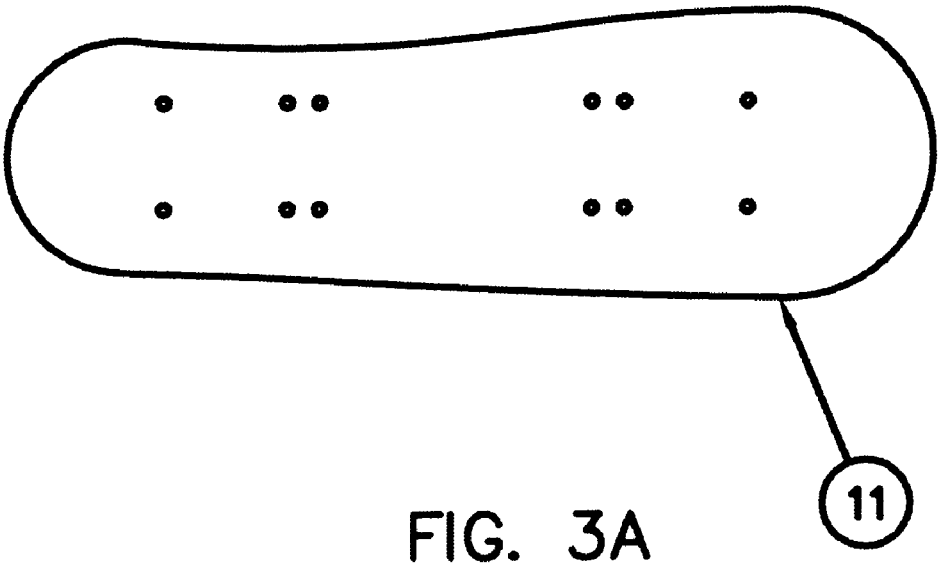
FIG. 3A is a top side view of the plate of an embodiment of the present invention.
Figure 3B:
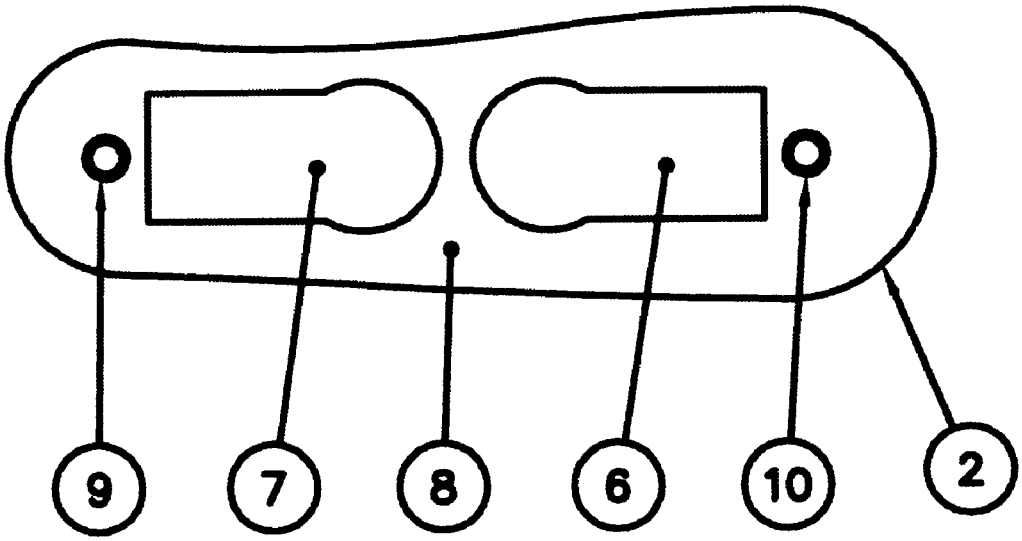
FIG. 3B is a bottom side view of the sole of the convertible shoe of an embodiment of the present invention.

The sole 2, shown in a bottom side view in FIG. 3B, is located below plate 11 and is connected to the underside of upper 1. The sole 2 and can be made of, for example, rubber or synthetic material, or other material known in the art to be a suitable material for a sole for this type of footwear. The sole 2 is capable of storing and enclosing the retracted wheel mechanism in cavities 6, 7, 9 and 10.

Figure 4:
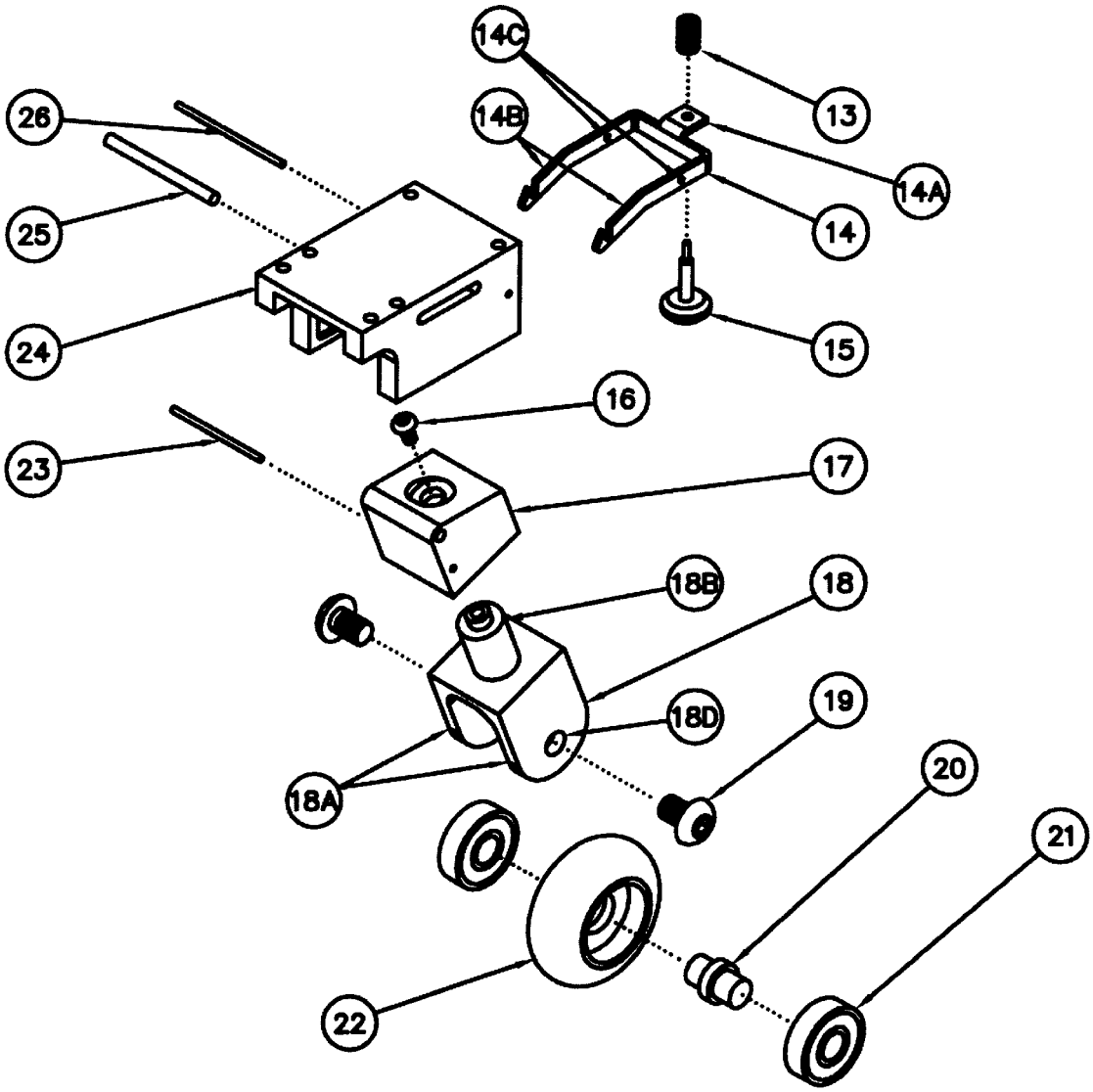
FIG. 4 is an exploded view of the swivel hinge wheel assembly of an embodiment of the present invention.

The wheel mechanism is connected to the underside of plate 11, and comprises one or more swivel hinge assemblies ("SHA's") 3, shown in FIG. 4. In this embodiment, the plate 11 is connected to an anterior and a posterior SHA 3. Each SHA 3 includes a base housing 24, a swivel wheel yoke 18, a sub-housing 17, and a wheel 22. The SHA's 3 can be connected to the plate 11 by, for example, screws 12 that pass through pre-drilled or formed holes in plate 11 and are screwed into the base housing 24.

Referring to FIG. 4, the wheel 22 can be of materials such as, for example, molded rubber, metal, or synthetic material. The wheel 22 preferably has a diameter greater than about one inch which increases the clearance between the non-wheel components of the convertible shoe and the ground or skating surface, and allows safer more aggressive skating. The wheel 22 is rotatably mounted on an axle 20 via wheel bearings 21 that support the wheel 22 on the axle 20. With the wheel 22 and the bearings 21 mounted, the axle 20 can be connected to a swivel wheel yoke 18 having side members 18A by, for example, screws 19 that run through a hole 18D in each side member 18A of the yoke 18 and into the ends of the axle 20.

Figure 6:
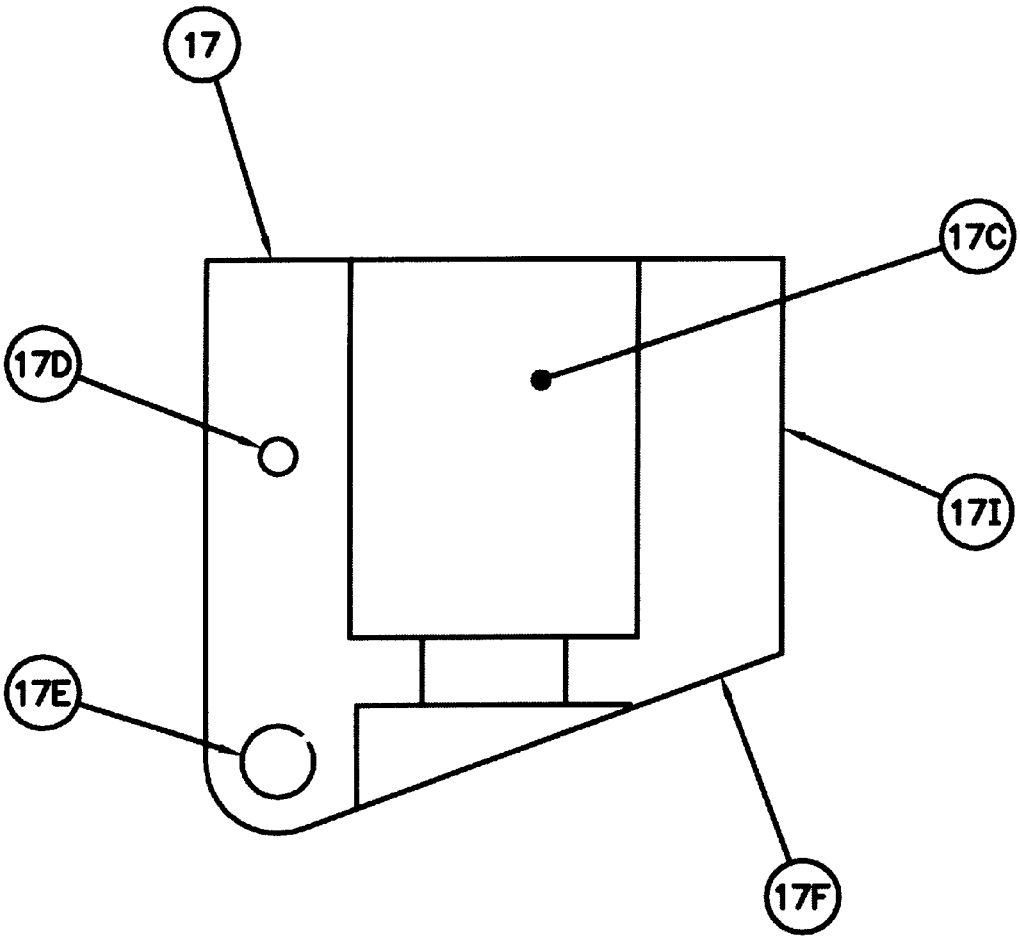
FIG. 6 is a sectional view of the sub-housing of an embodiment of the present invention.

The swivel wheel yoke 18 has a cylindrical shank 18B that can be rotatably located in a cylindrical opening 17C in the sub-housing 17, shown in FIG. 6. The shank 18B can be held in the cylindrical opening 17C by, for example, a screw 16. With the cylindrical shank 18B thus held, the swivel wheel yoke 18 can swivel or rotate 360 degrees while connected to the sub-housing about an axis perpendicular to the rolling axis of wheel 22.

Referring to FIG. 4 and FIG. 6, the sub-housing 17 is constructed of metal, fiber or synthetic material and includes a hole sized to accept the cylindrical shank 18B of the swivel wheel yoke 18. The sub-housing 17 is rotatably secured to the base housing 24 by a hinge pin 25 that allows the sub-housing 17 to both hinge and slide into a retracted position for walking and into an extended position for skating. The sub-housing 17 contains a hinge pin hole 17E. The hinge pin 25 extends through the hinge pin hole 17E of sub-housing 17, and each end of hinge pin 25 protrudes into elongated holes 24F (shown in FIG. 5) in the base housing 24, allowing the sub-housing 17 to hinge and slide when extending or retracting the SHA 3. The hinge pin 25 can slide from one end to the other of the elongated holes 24F allowing the sub housing 17 to move in a hinging motion as the swivel wheel yoke 18 is retracted or extended.

Figure 5:
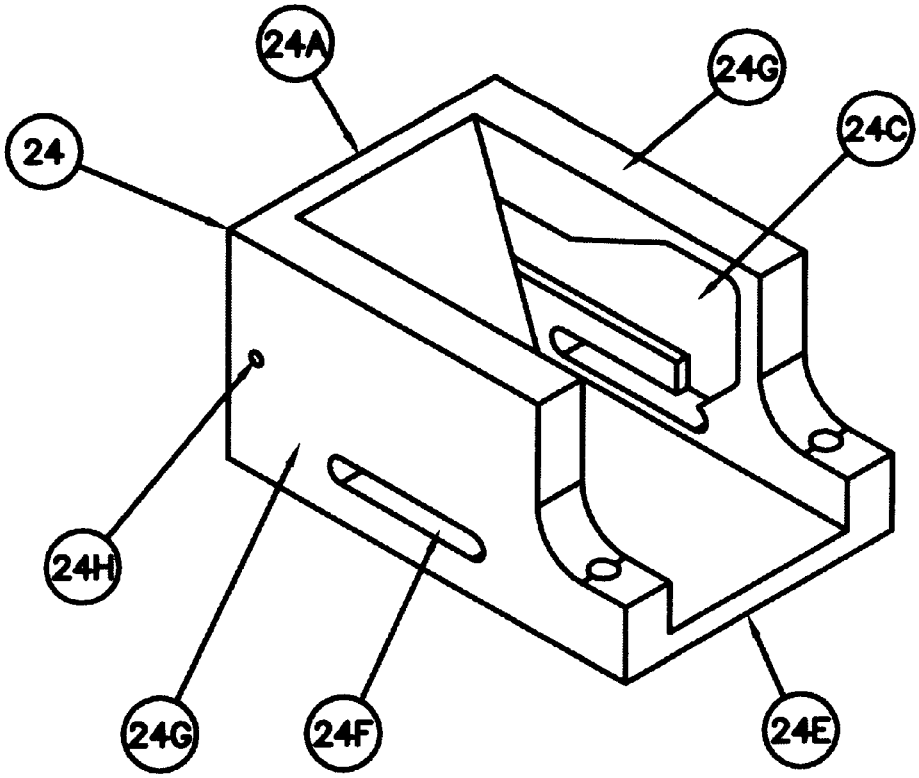
FIG. 5 is a perspective view of the base housing of an embodiment of the present invention.
Figure 5A:
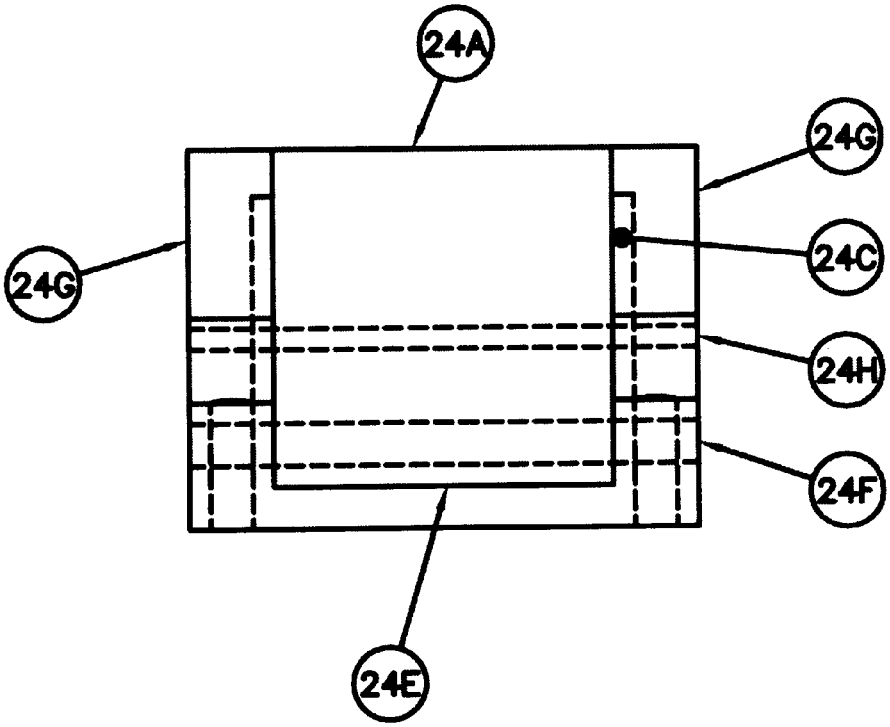
FIG. 5A is a front elevation of the base housing of FIG. 5.
Figure 5B:
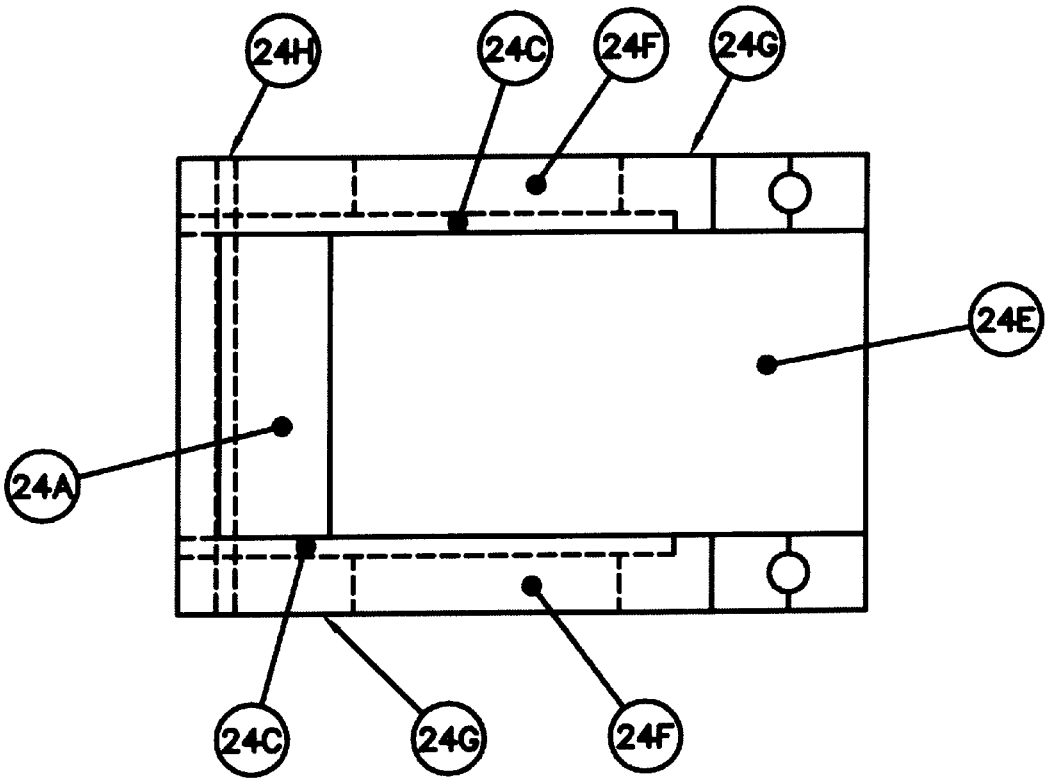
FIG. 5B is a top elevation of the base housing of FIG. 5.
Figure 5C:
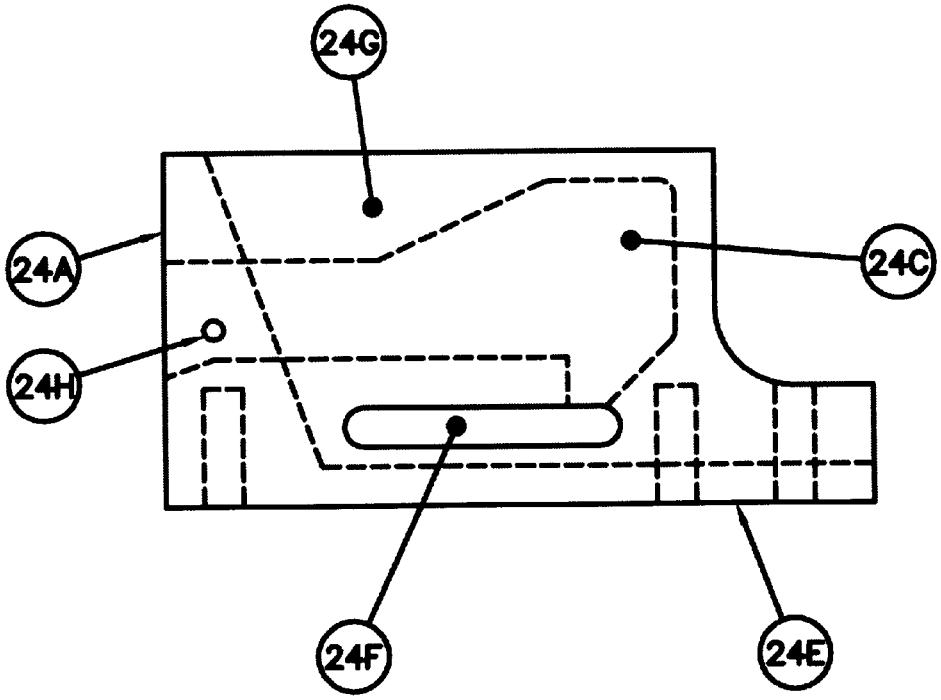
FIG. 5C is a side elevation of the base housing of FIG. 5.

The sub-housing 17 also includes a top surface 17F, and an adjacent surface 17I. Referring to FIG. 4, FIG. 5, and FIG. 6, when the SHA 3 is extended, the top surface 17F of sub-housing 17 contacts a base housing mounting wall 24E of base housing 24, and the sub-housing surface 17I lays flush against an angled wall 24A of the base housing 24.

The SHA 3 additionally comprises a locking mechanism to lock the SHA in an extended position. The sub-housing 17 includes a drilled or preformed locking pin hole 17D through which can be inserted a locking pin 23 which extends through and protrudes on either side of the sub-housing 17. The protruding locking pin 23 ends can be engaged by the locking mechanism.

Referring to FIG. 4, FIG. 5, FIG. 5A, FIGS. 5B, and 5C, the base housing 24 is fabricated from metal, fiber or synthetic material and comprises two side walls 24G, the mounting wall 24E and the angled wall 24A. Within each side wall 24G is formed or machined a recess 24C. The recesses 24C extend through the angled wall 24A. A base housing hinge pin hole 24H, capable of accepting a dual locking arm hinge pin 26, extends through the angled wall 24A and through both side walls 24G.

Referring to FIG. 4, the locking mechanism comprises a dual arm mechanism 14 having dual locking arms 14B with hooked ends, a tab 14A, locking mechanism hinge pin holes 14C, a lock spring 13 and a lock release button 15. The dual locking arms 14B pass through the recesses 24C with their hooked ends facing the mounting wall 24E of the base housing 24. The dual arm mechanism 14 is pivotably connected to the base housing 24 by the dual locking arm hinge pin that passes through dual locking arm holes 14C and through hinge pin hole 24H.

Figure 1A:
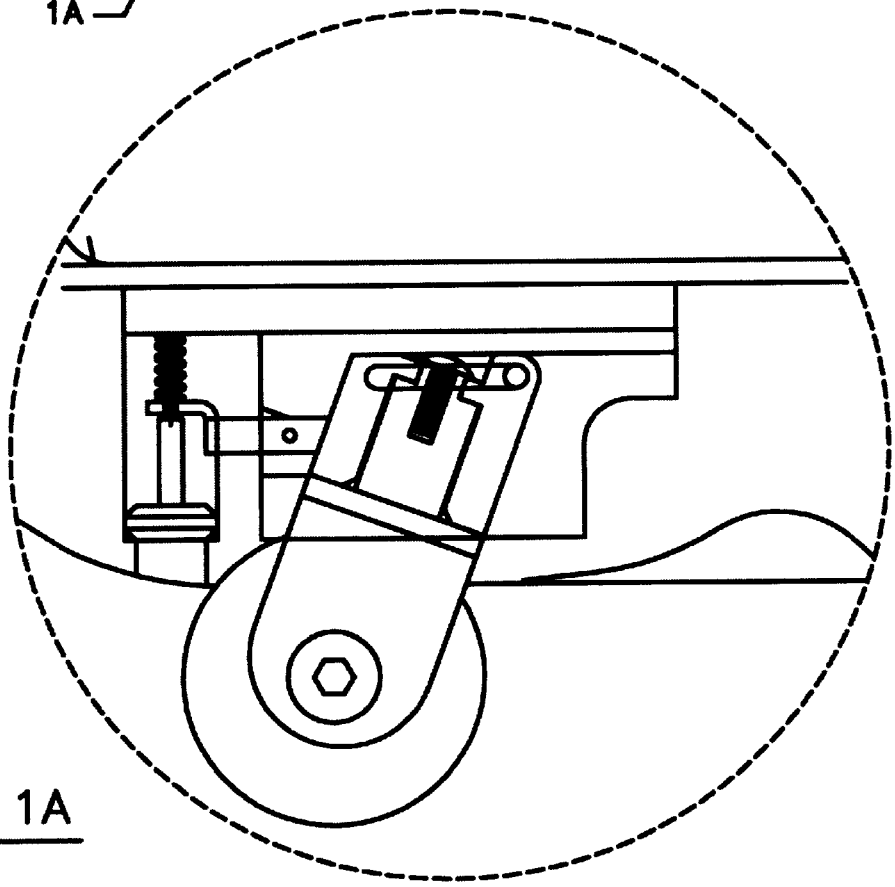
FIG. 1A is an enlarged sectional view of the extended wheel mechanism of FIG. 1.
Figure 2A:
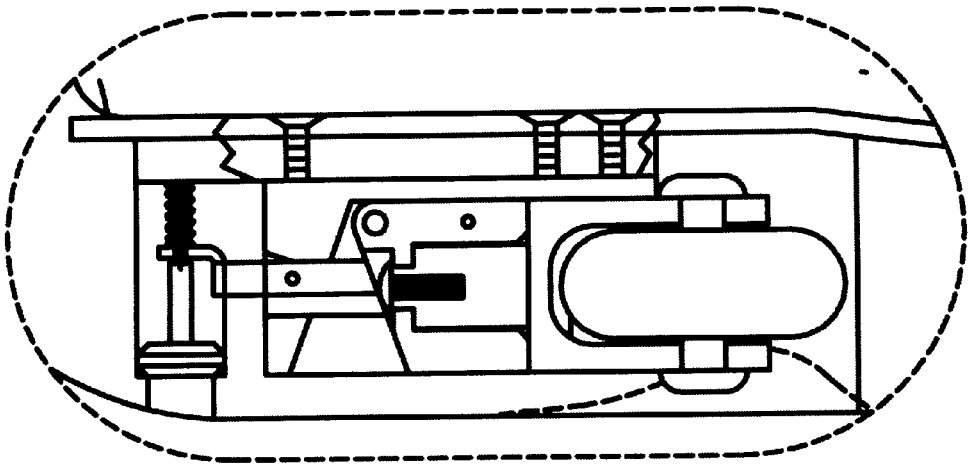
FIG. 2A is an enlarged sectional view of the retracted wheel mechanism of FIG. 2.

Referring to FIG. 1, FIG. 2 and FIG. 4, located in each cavity 9 and 10 is a lock release button 15, a lock spring 13 and the tab 14A of a dual arm mechanism 14. The lock release button 15 is made of metal, fiber or synthetic material and extends through the lock spring 13 to the tab 14A and a length of smaller diameter that extends through the hole in the tab 14B into the spring 13. When the button 15 is depressed it pushes the tab 14A causing the dual arms 14B to pivot on hinge pin 26, releasing the hooked ends from the lock pin 23. This allows the sub-housing 17 to hinge and slide, and the swivel wheel yoke 18 swivel into a retracted or walking position. An enlarged sectional view of the extended SHA is shown in FIG. 1A, and an enlarged sectional view of the retracted SHA is shown in FIG. 2A.

Referring to FIG. 1, FIG. 2 and FIG. 3, the sole 2 includes anterior and posterior cavities 6, 7, posterior and anterior lock release cavities 9, 10, and a lower plane that defines a walking surface 8. These cavities extend from the walking surface of the sole 8 to the plate 11 and the heel pad 5. Anterior assembly cavity 6 and posterior assembly cavity 7 house or store the anterior and posterior SHA's 3 respectively.

Posterior lock release cavity 9 and anterior lock release cavity 10 are smaller and house lock release buttons 15 which extend through tab ends 14A of dual lock arms 14 and into the spring 13. Cavity 6 is located in the anterior portion of the sole 2 and is configured or shaped to hold a retracted SHA 3. Cavity 7 is located in the posterior portion of sole 2 and is configured or shaped to hold a retracted SHA 3.

Posterior and anterior cavities 9 and 10 are shaped to accommodate the shape of the lock mechanism. The walking surface 8 end of cavities 9 and 10 is a smaller diameter than the interior of the cavity itself so as to retain the lock release button 14 within the cavities. Cavities 6 and 7 are connected to cavities 10 and 9 respectively through an opening within the sole 2 through which the dual lock arm tabs 14A can extend from the base housings 24 located in cavities 6 and 7 to the lock release button stem 15 located in cavities 9 and 10.

Figure 7:
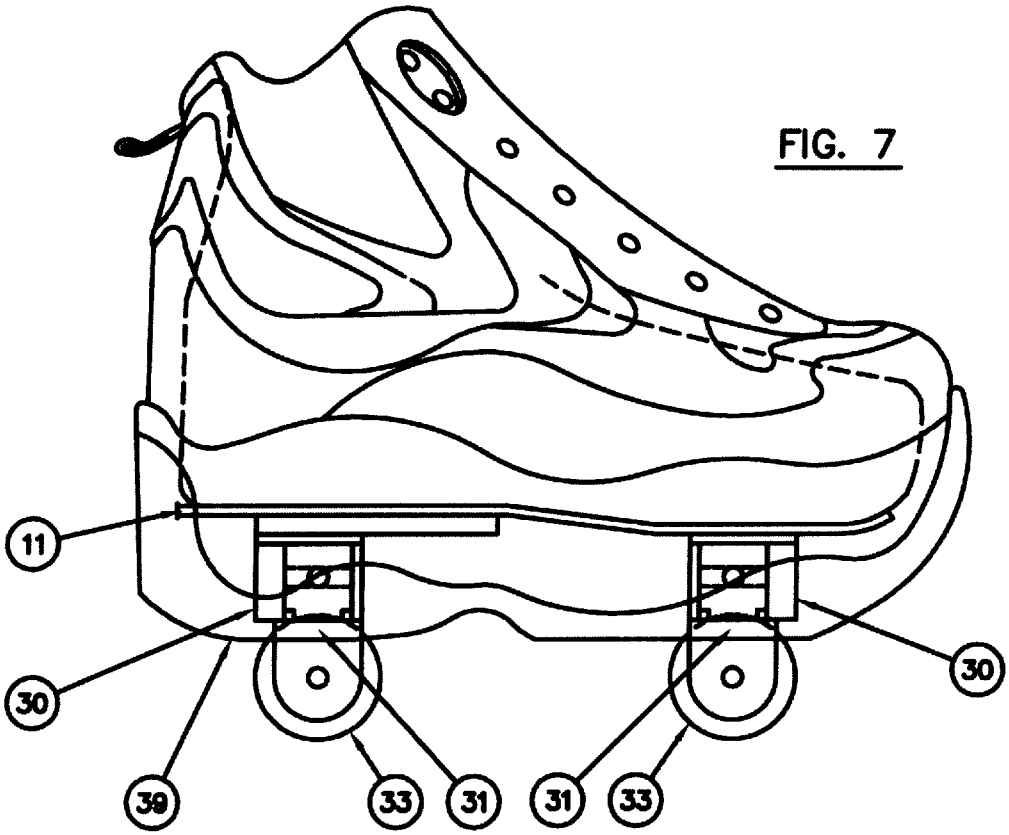
FIG. 7 is a side partial sectional view of another embodiment of the present invention with the wheel mechanism extended.
Figure 8:
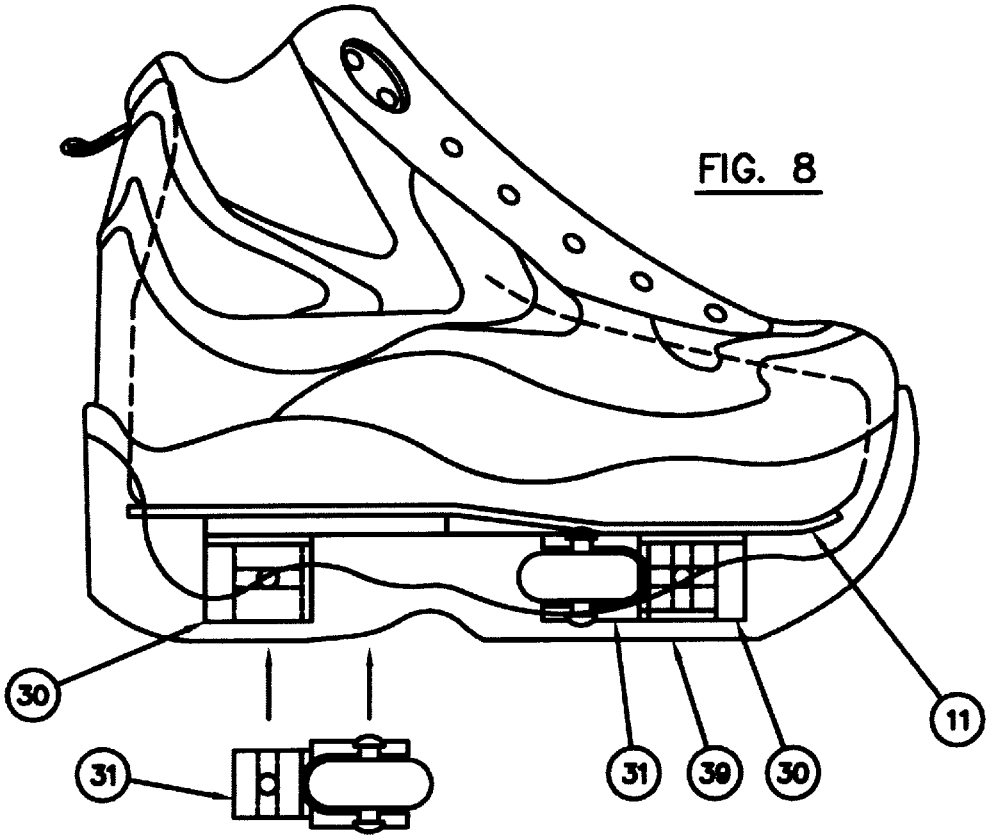
FIG. 8 is a side partial sectional view of another embodiment of the present invention with the wheel mechanism retracted.
Figure 9:
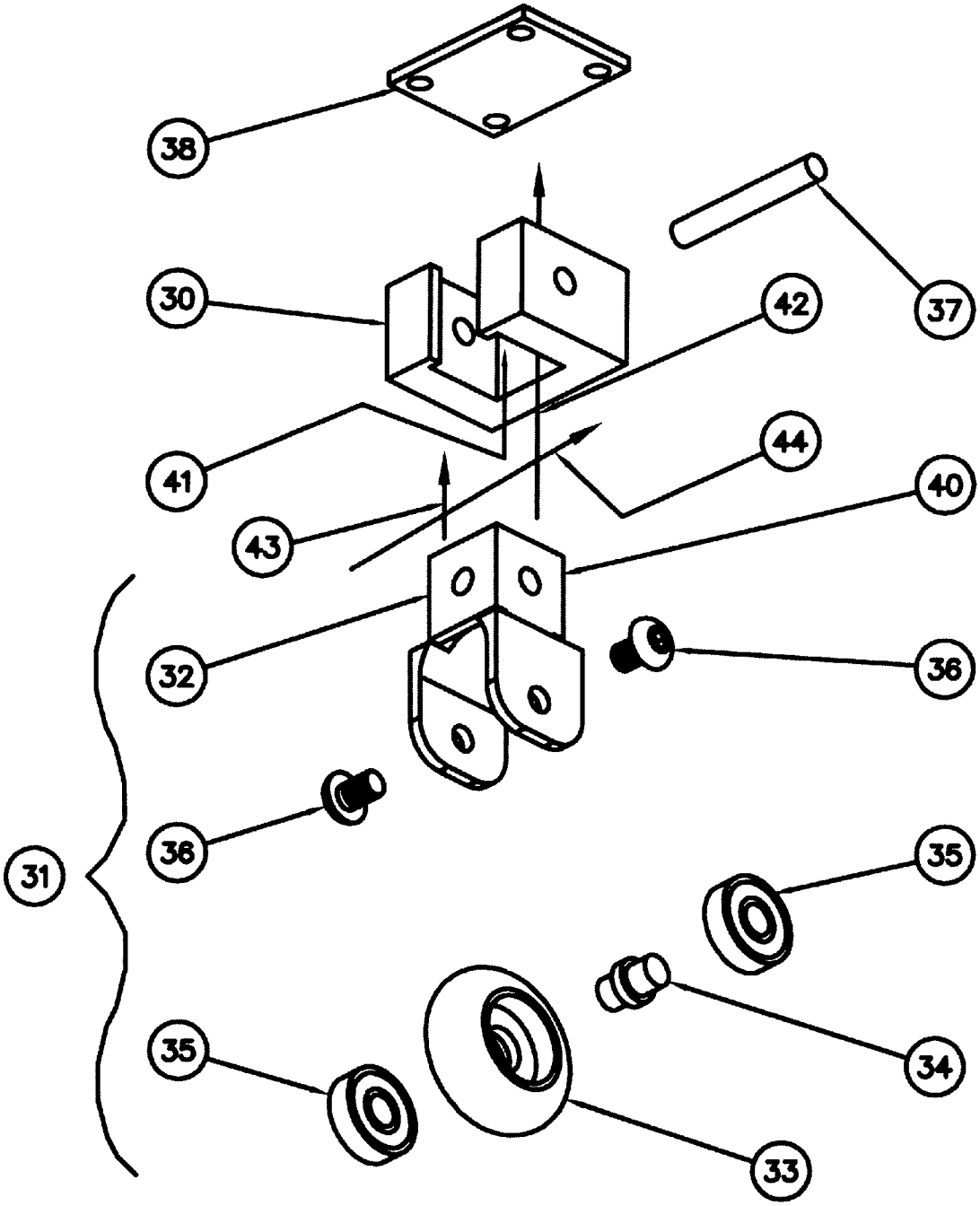
FIG. 9 is an exploded view of the wheel mechanism of another embodiment of the present invention.

In another embodiment of the present invention shown in FIG. 9, the wheel mechanism can comprise at least one mounting bushing 30 having a cavity 41 defining a keyway parallel to a first keyway axis 42, and at least one removable wheel yoke assembly 31 mountable in the cavity 41. The wheel yoke assembly 31 can comprise a yoke 32 having a wheel 33 rotatably mounted thereon via an axle 34 and bearings 35. The axle 34 can be mounted on the yoke 32 via, for example, screws or pins 36 that pass through holes in the yoke 32 and into the ends of the axle 34. The yoke 32, having first key axis 43 and a second key axis 44, which are non-parallel axes, can include a mandrel or shank 40. The shank 40 is shaped to define a key parallel to the first key axis 43 and the second key axis 44, the key being slidably engagable with the keyway of the cavity 41 when either of the first key axis 43 and the second key axis 44 of the shank 40 are aligned with the keyway axis 42. When the first key axis 43 is aligned with the keyway axis 42, the shank 40 can be inserted into the cavity 41 and held in the mounting bushing 30 with the wheel 33 about perpendicular to the walking surface of the convertible shoe's sole 39 and parallel to the skating direction, as shown in FIG. 7. A locating pin 37 can be inserted through a hole in the mounting bushing 30 and through the shank 40 of the wheel yoke assembly 31 to lock the wheel yoke assembly 31 in the mounting bushing 30. With wheel yoke assemblies 31 thus mounted, the wheel mechanism is extended, and the convertible shoe can be used as an in-line skate as shown in FIG. 7. Alternatively, when the second key axis 44 is aligned with the keyway axis 42, the shank 40 can be inserted into the mounting bushing cavity 41 with the wheel yoke assembly 31 in a retracted position, as shown in FIG. 8, and with the wheel 33 about parallel to the shoe's sole 39. With the wheel yoke assembly 31 thus mounted, the convertible shoe can be used for walking. The wheel yoke assembly 31 can be locked in this position by the locating pin 37 that can be inserted through hole in the mounting bushing 30, and through holes in the shank of the wheel yoke assembly 31. Mounting bushings 30 can be connected to the underside of the upper of the convertible shoe by, for example, attaching the mounting bushing 30 to plate 11, as shown in FIG. 7 and FIG. 8. A mounting base plate 38 can be located between the mounting bushing and the plate 11.

While particular embodiments of the present invention have been illustrated and described herein, the present invention is not limited to such illustrations and descriptions. It is apparent that changes and modifications may be incorporated and embodied as part of the present invention within the scope of the following claims.

What is claimed is:

1. A convertible shoe comprising:

an upper having an underside;

a sole coupled to the underside of the upper, the sole having a lower plane, and having storage cavities formed therein; and an extendable and retractable wheel mechanism operatively coupled to the underside of the upper, and comprising at least a wheel positionable to be about perpendicular to the lower plane of the sole when the wheel mechanism is in its extended position, and parallel to the lower plane of and housed by the sole when the wheel mechanism is in its retracted position, the wheel mechanism including a removable mechanism having the wheel rotatably mounted thereon and being rotatable about an axis perpendicular to the lower plane of the sole in order to place the mechanism in its retracted position.

2. A convertible shoe comprising:

an upper having an underside;

a sole coupled to the underside of the upper, the sole having a lower plane, and having storage cavities formed therein; and an extendable and retractable wheel mechanism operatively coupled to the underside of the upper, and comprising at least a wheel positionable to be about perpendicular to the lower plane of the sole when the wheel mechanism is in its extended position, and parallel to the lower plane of and housed by the sole when the wheel mechanism is in its retracted position, wherein the wheel mechanism includes a swivel mounting having at least one of the wheels rotatablely mounted thereon, the swivel mounting permitting the wheel to swivel about an axis perpendicular to the wheel's rolling axis; and a hinged mounting swivably mounted on the swivel mounting and coupled to the underside of the upper so that the wheel mechanism can be extended and retracted.

3. A convertible shoe comprising:

an upper having an underside;

a sole coupled to the underside of the upper, the sole having a lower plane, and having storage cavities formed therein; and an extendable and retractable wheel mechanism operatively coupled to the underside of the upper, and comprising at least a wheel positionable to be about perpendicular to the lower plane of the sole when the wheel mechanism is in its extended position, and parallel to the lower plane of and housed by the sole when the wheel mechanism is in its retracted position, wherein the wheel mechanism includes at least one removable mounting having first and second non-parallel key axes, having a mandrel that defines a key along the first and the second key axes, and having at least one wheel rotatably mounted on the removable mounting; and at least one bushing having a cavity that defines a keyway parallel to a keyway axis, the keyway being slidably engageable with the key when the keyway axis and one of the first and the second key axes are aligned, the removable mounting being mountable on the bushing by slidably engaging the mandrel with the cavity.

* * * * *